United States Patent [19]

Lee

[11] Patent Number: 4,527,634

[45] Date of Patent: Jul. 9, 1985

[54] EMERGENCY VAPOR POWERED PUMP ASSEMBLY

[75] Inventor: John T. M. Lee, Phoenixville, Pa.

[73] Assignee: ICI Americas Inc., Wilmington, Del.

[21] Appl. No.: 467,086

[22] Filed: Feb. 16, 1983

Related U.S. Application Data

[63] Continuation-in-part of Ser. No. 354,223, Mar. 3, 1982, Pat. No. 4,466,489.

[51] Int. Cl.[3] ..... A62C 27/16

[52] U.S. Cl. ..... 169/13; 60/671; 417/379

[58] Field of Search ..... 169/13; 60/651, 671; 417/379

[56] References Cited

U.S. PATENT DOCUMENTS

| | | | |
|---|---|---|---|
| 1,250,423 | 12/1917 | Boyden, Jr. . | |
| 3,234,746 | 2/1966 | Cope . | |
| 3,649,136 | 3/1972 | Ruidisch . | |
| 3,990,245 | 11/1976 | Heilemann | 60/671 |
| 4,068,476 | 1/1978 | Kelsey | 417/379 X |
| 4,156,343 | 5/1979 | Stewart | 60/671 |
| 4,285,201 | 8/1981 | Stewart | 60/671 X |

*Primary Examiner*—Andres Kashnikow

*Attorney, Agent, or Firm*—John M. Sheehan

[57] ABSTRACT

Vapor powered pump assembly for emergency use. The assembly comprises a pump, a vapor powered engine, a container for storing a volatile propellant in liquid form under pressure, a heat exchanger for transferring heat from the fluid (usually a liquid) being pumped to the propellant, and means for delivering propellant vapors from the heat exchanger to the engine. The container for propellant may be either a plurality of tubes, each closed at one end, inside the heat exchanger as in FIG. 1, or a separate vessel as in FIG. 2.

4 Claims, 2 Drawing Figures

EMERGENCY VAPOR POWERED PUMP ASSEMBLY

CROSS REFERENCE TO RELATED APPLICATION

This application is a continuation-in-part of applicant's copending application Ser. No. 354,223, filed Mar. 3, 1982, now U.S. Pat. No. 4,466,489.

BACKGROUND OF THE INVENTION

Field of the Invention

This invention relates to a vapor powered apparatus for pumping a liquid. More particularly, this invention relates to a vapor powered pump assembly, especially suited for emergency use such as fire fighting, which uses a liquifiable propellant gas in vapor form as its source of motive power.

Applicant's Prior Application

Applicant's copending application Ser. No. 354,223, cited supra, describes and claims an apparatus in which water is stored in a tank at atmospheric pressure for emergency use (for example, to fight a fire), and is delivered on command by pressurizing the tank with a liquifiable propellant in vapor form. The propellant is stored as a liquid prior to use of the apparatus. Operation of the apparatus is initiated by opening a valve which allows the propellant to vaporize and flow into the water tank. The water being delivered supplies the heat of vaporization of the propellant by indirect heat exchange. According to one embodiment (that shown in FIGS. 7–9), the water tank may be refilled via a refill line when the apparatus is not in use: this refill line cannot be used while the apparatus is in use unless the pressure available in the refill line is equal to or greater than the operating pressure.

Description of the Prior Art

U.S. Pat. No. 3,234,746 to Cope describes a process and apparatus for pumping liquid carbon dioxide from one container to another. Carbon dioxide vapor from the supply container is used as the motive fluid to drive a reciprocating pump and engine assembly which pumps the liquid carbon dioxide.

U.S. Pat. No. 1,250,423 describes a combined steam engine and water pump in which the engine and the pump have reciprocating pistons with a common piston rod.

U.S. Pat. No. 3,649,136 also describes a combined engine and pump which includes an engine piston and a pump piston attached to a common piston rod.

U.S. Pat. No. 4,285,201 to Stewart describes a vapor powered engine assembly which comprises a closed loop circulating system for a low boiling point liquid and its vapor. The apparatus is disclosed as particularly adapted for driving a pump for pumping well water. The vapor of the low boiling point liquid, which may be carbon dioxide or a "Freon", powers the engine. Low pressure vapor is cooled and condensed by a portion of the water stream being pumped in one portion of the loop. The resulting liquid is expanded and vaporized and the resulting high pressure vapor is heated by hot water in another portion of the loop. The hot water is heated by solar energy, either alone or supplemented with a fuel. A major object is to utilize solar energy or other naturally occurring energy sources for driving an engine assembly.

U.S. Pat. No. 4,156,343 to Stewart shows a power generating assembly which utilizes the vapor of a volatile liquid, such as carbon dioxide or a "Freon", as its working fluid. The liquid and its vapor circulate in a closed system. The vapor is superheated in one portion of this system by heat exchange with a warm or hot naturally available fluid, such as water or air.

SUMMARY OF THE INVENTION

According to this invention there is provided an emergency vapor powered pump assembly comprising a pump for pumping a liquid, a vapor powered engine for driving the pump, container means for storing a volatile propellant in liquid form under pressure, heat exchange means for boiling the liquid propellant by indirect heat exchange with the liquid being pumped, and conduit means for conveying said propellant under pressure from the container means to the vapor powered engine. The pump assembly is particularly useful for pumping water.

DESCRIPTION OF THE PREFERRED EMBODIMENTS

Description

Figure 1:
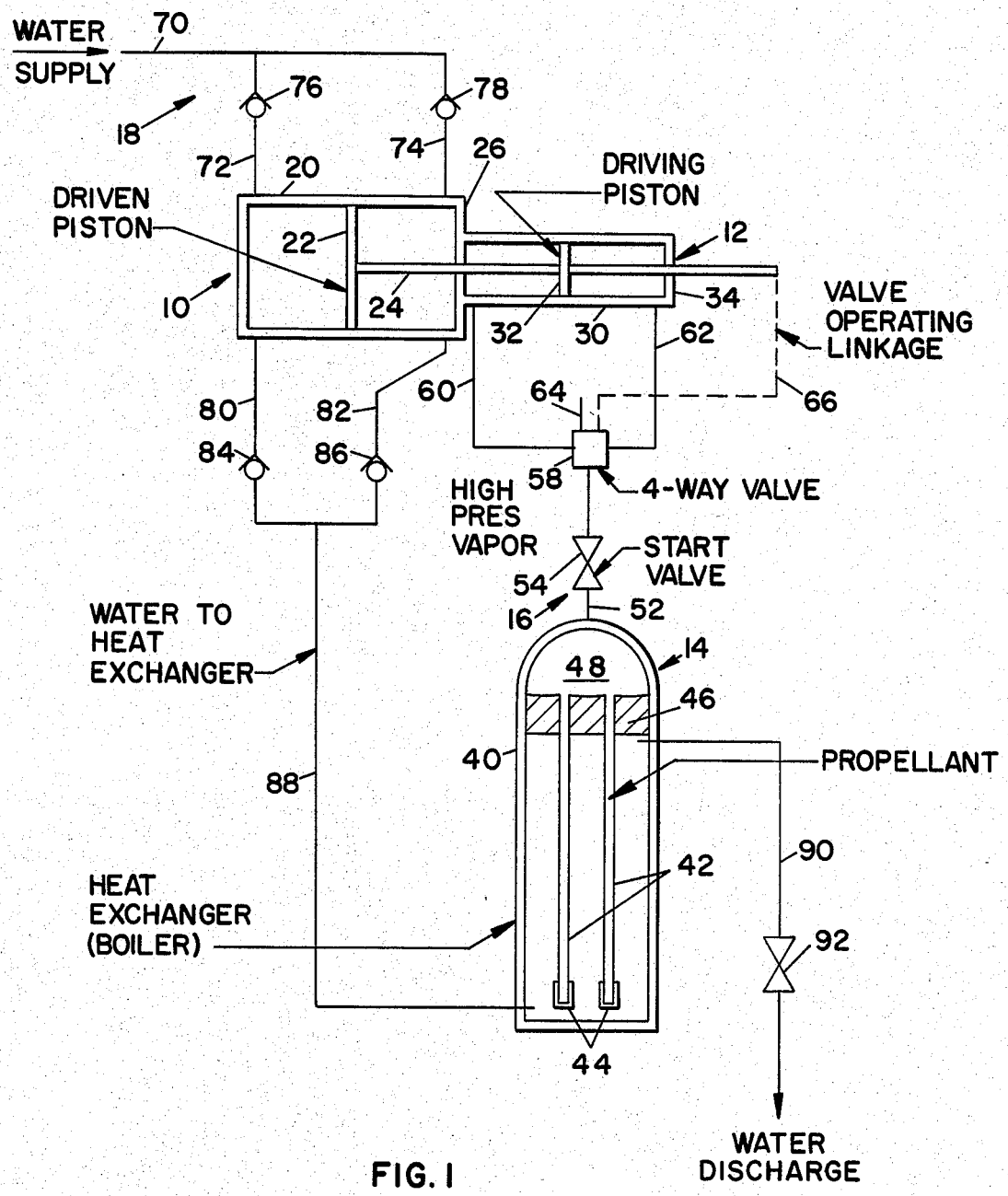
FIG. 1 is a schematic diagram of the pump assembly of this invention according to a preferred embodiment thereof.

Referring now to FIG. 1, the pump assembly according to a preferred embodiment of this invention comprises a pump 10, a vapor powered engine 12 which drives pump 10, a heat exchanger 14 which serves both as a container and as a boiler for liquid propellant or working fluid under pressure, and a propellant conduit system 16 which delivers vapors of the propellant under pressure from the heat exchanger 14 to the engine 12. This pump assembly, when in operation, pumps water or other liquid from a low pressure to a higher pressure. A feature of this invention is that a stream of water or other liquid being pumped is used to supply heat to the liquid propellant via indirect heat exchange in heat exchanger 14, and thereby provide the heat necessary to vaporize the propellant.

Water conduit system 18 receives water from a low pressure source and delivers water at high pressure to the point of use. During passage through the conduit system 18, water is pumped from a low pressure to a higher pressure in pump 10, and is passed through heat exchanger 14 in order to provide heat to the boiling propellant.

The preferred embodiment of this invention will now be described in detail with respect to FIG. 1.

Pump 10 as shown is a double acting reciprocating pump comprising a hollow cylinder 20 having a reciprocating driven piston 22 therein. Piston 22 is attached to a piston rod 24, which extends through an opening in one end wall 26 of cylinder 20. Seals (not shown) are provided on the periphery of piston 22, and on the end wall 26 around the opening therein, in order to provide fluid tight engagement between piston 22 and cylinder 20, and between piston rod 24 and end wall 26.

Engine 12 is a double acting reciprocating piston motor comprising a hollow cylinder 30 having a reciprocating driving piston 32 therein. Piston 32 is mounted for reciprocation on piston rod 24, so that driving piston 32 and driven piston 22 reciprocate as a unit. Pump 10 and engine 12 share a common end wall 26. Piston rod 24 extends through the opposite end wall 34 of engine 12, and is connected to a valve operating linkage (to be hereinafter described) which controls the supply of high pressure vapor to cylinder 30. Seals on piston 32 and end wall 34 provide fluid tight engagement between piston 32 and cylinder 30, and between piston rod 24 and end wall 34.

Pump cylinder 20 is illustrated as being of larger diameter than engine cylinder 30. This is a desirable arrangement when propellant vapor is available at a higher pressure than the required water delivery pressure. The relative diameters of cylinders 20 and 30 will depend on the relationship between available propellant vapor pressure and required water delivery pressure.

Other types of engines and pumps can be used in place of those illustrated. For example, a rotary pump can replace the reciprocating pump 10, and a rotary vapor powered engine can replace the reciprocating engine 12.

Heat exchanger 14 includes a vertical cylindrical casing or shell 40. Inside shell 40 are a plurality of vertical tubes 42, which are open at their upper ends and closed at their lower ends. The lower ends may be closed by any suitable means, e.g., by caps 44. The tubes 42 are suspended from tube sheet 46, which is near the top of heat exchanger 14. The tubes 42 serve as containers for the propellant in liquid form. A heating fluid, preferably water as will be hereinafter described, may be circulated between the shell 40 and the tubes 42, thereby providing the heat of vaporization necessary to cause the propellant to boil. A dome or vapor space 48 for propellant vapor is provided above tube sheet 46. The heat exchanger 14 is structurally like that shown in FIG. 7 of my copending application Ser. No. 354,223.

The propellant conduit system 16 includes a conduit 52 having a starting valve 54 therein. Conduit 52 receives propellant vapor under pressure from the dome 48 of heat exchanger 14.

Starting valve 54 is used to initiate operation of the pump assembly. Valve 54 is normally closed. In that position propellant is prevented from flowing. When valve 54 is opened, propellant vapor is permitted to flow from heat exchanger 14 to engine 12. Valve 54 may be manually operated. Alternatively, valve 54 may be electrically operated, in which case it may be initiated manually, e.g., by a push button switch, or automatically in response to a condition such as elevated temperature.

Four-way valve 58 directs propellant vapor under pressure alternately to the opposite ends of engine 12. In one position of four-way valve 58, branch conduit 60 is in communication with conduit 52, so that vapor under pressure is directed to the left end of engine 12. At the same time low pressure vapor from the right end of engine 12 is vented to the atmosphere or to a low pressure receptacle (not shown) via branch conduit 62 and vent line 64. This causes the piston assembly consisting of pistons 22 and 32 and piston rod 24 to move to the right. In the other position of valve 58, conduits 52 and 62 are in communication so that the right end of piston 12 is pressurized, and conduit 60 and the left end of engine 12 are vented. This causes the piston assembly to move to the left.

A valve operating linkage 66, shown schematically, reverses the position of four-way valve 58 as piston 32 approaches either end of its travel. Details of linkage 66 have been omitted since the provision of a suitable linkage is within the skill of the art.

The water supply system 18 includes a water supply conduit 70 for low pressure water, and branch conduits 72 and 74 connected thereto. Water supply conduit 70 can receive water from any available source, such as a municipal water main, a well or reservoir, or a storage tank, at any available pressure. Branch conduits 72 and 74 have check valves 76 and 78, respectively. Branch conduits 72 and 74 supply low pressure water to the left end and the right end, respectively, of pump 10. Water supply system 18 also includes high pressure branch conduits 80 and 82, which receive high pressure water from the left and right ends, respectively, of pump 10. Branch conduits 80 and 82 have check valves 84 and 86, respectively. High pressure conduit 88 receives water from conduits 80 and 82. Conduit 88 terminates at the bottom of heat exchanger 14. Water from conduit 88 flows upwardly through heat exchanger 14 in the space surrounding tubes 42. A water discharge conduit 90 for high pressure water extends from the upper portion of heat exchanger 14 to the point of use. The discharge end of conduit 90 may be provided with a nozzle or sprinkler head not shown. A manually operated normally open valve 92 may be provided in conduit 90 or elsewhere in the water supply system 18 to permit shutdown of the system.

Carbon dioxide is the preferred propellant. Carbon dioxide is a gas at ordinary temperatures and atmospheric pressure, but can be liquified and stored in the liquid state under pressure at temperatures up to about 31° C. (88° F.). Carbon dioxide has a high vapor pressure, which makes possible a high work output with a relatively small engine size. Also, carbon dioxide is environmentally acceptable, so that it can be released into the atmosphere without causing pollution. Other propellants can be used: examples include dichlorodifluoromethane ($CCl_2F_2$) and chlorodifluoromethane ($CHClF_2$). These compounds have lower vapor pressures than carbon dioxide; operating pressures are lower, and a larger engine is required for a given work output, when one of these compounds is used instead of carbon dioxide.

Figure 2:
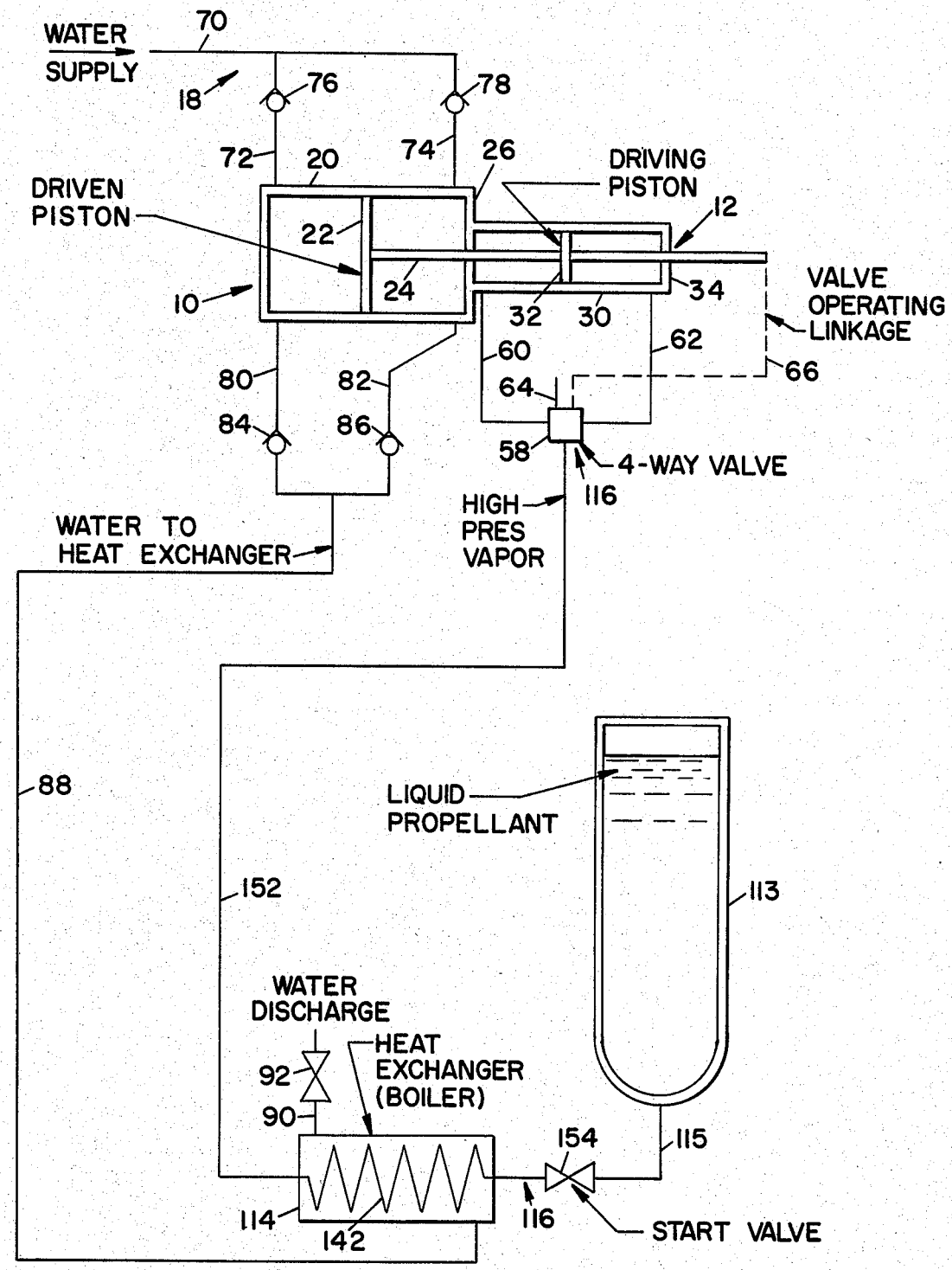
FIG. 2 is a schematic diagram of the pump assembly of this invention according to an alternative embodiment.

FIG. 2 illustrates a modified form of the present invention. In this embodiment, the propellant storage tank 113 and the heat exchanger 114 are separate vessels, which are connected by a line 115 for liquid propellant. The heat exchanger in this embodiment may be of conventional construction, such as the helical coil heat exchanger shown or a tubular heat exchanger.

Referring now to FIG. 2, the propellant (such as carbon dioxide) is stored in liquid form under pressure in tank 113. There is some propellant vapor in the upper portion of the tank. Liquid propellant is withdrawn from the bottom of tank 113 via line 115, which has a starting valve 154 therein. In this embodiment the propellant conduit system 116 includes line 115 in addition to vapor lines to be described for conveying propellant vapor from the heat exchanger 114 to engine 12. Starting valve 154 can be actuated in the same ways as starting valve 54 in FIG. 1.

Liquid propellant flows from line 115 into the helical coil 142 of heat exchanger 114, where the propellant is vaporized. The heat of vaporization is supplied by indirect heat exchange with high pressure water, which flows concurrently with the propellant in the shell space surrounding coil 142. Water from conduit 88 enters heat exchanger 114 at the same end as that at which liquid propellant enters. Water flows from the other end of heat exchanger 114 into discharge conduit 90. Propellant vapor under high pressure is discharged from coil 142 into conduit 152. Four way valve 50 directs vapor from conduit 152 alternately to conduit 60 or conduit 62, as in FIG. 1.

The remainder of the pump assembly of FIG. 2 has the same structure as that shown in FIG. 1, and the same reference numerals are used.

Various modifications in addition to those previously indicated can be made. For example, the heat exchanger 14 or 114 can be placed upstream of the pump 10, so that low pressure water is used instead of high pressure water as the medium for heating and vaporizing the propellant. Also, liquids other than water can be pumped by the apparatus of this invention. The choice of liquid depends on the intended use of the apparatus.

The pump assembly of this invention is intended for emergency use. A preferred use is for fire fighting. For this purpose the water supply conduit 70 is connected to any suitable water source, such as a water main, well, reservoir, etc. Any available water pressure, whether atmospheric or higher, can be used. The discharge end of discharge conduit 90 is placed at the location to be protected against fire, and is provided with a nozzle or sprinkler head which directs a stream of water toward the object or location to be protected. The starting valve 54 or 154 may be initiated either manually or automatically as previously indicated.

Operation

Operation of the pump assembly of this invention will now be described with reference to the embodiment shown in FIG. 1.

Prior to operation, tubes 42 are filled with liquid propellant and starting valve 54 is closed. The engine may be pre-positioned so that piston 32 is at or near one end or the other of its travel. The four-way valve 58 may be positioned to place passageway 52 in communication with either branch conduit 60 or branch conduit 62. "Neutral" positions of four-way valve 58, in which neither of the branch conduits 60 or 62 is in communication with conduit 52, should be avoided. The apparatus is in a static state, and no heat transfer in heat exchanger 14 takes place.

Valve 54 is opened to start operation of the pump assembly. This permits propellant vapor to flow to engine 12. Pressure is maintained by vaporization of liquid propellant in tubes 42. Water flowing through the shell side of heat exchanger 14 supplies the necessary heat of vaporization. Propellant vapor is directed alternately to one end and then to the other end of engine 12. This causes pistons 22 and 32 to reciprocate. Propellant is exhausted from engine 12 to the atmosphere or to a low pressure receptacle. Reciprocation of piston 22 causes water to be drawn into pump 10 alternately to one end via conduit 72 and to the other end via conduit 74. High pressure water is discharged from pump 10 via conduits 80 and 82. Check valves 76, 78, 84 and 86 prevent backflow. Water flows from branch conduits 80 and 82 into conduit 88 then through the shell side of heat exchanger 14, then through discharge conduit 90 to the point of use.

Operation of the apparatus continues until all of the propellant liquid is vaporized or until valve 54 or valve 92 is closed.

The embodiment of FIG. 2 operates in the same manner as the embodiment of FIG. 1. Prior to operation, tank 113 is filled with liquid carbon dioxide or other propellant (except for a small vapor head space at the top of the tank), and valve 154 is closed. Valve 154 is opened to initiate operation.

After the apparatus has been used, it may be recharged and readied for reuse by filling tubes 42 in FIG. 1, or propellant storage tank 113 in FIG. 2, with a fresh charge of propellant. Alternatively in FIG. 2, a new tank 113 filled with propellant may replace the empty or partially emptied tank.

The operating pressure of propellant in the apparatus of either FIG. 1 or FIG. 2 depends on the propellant used and the water temperature in heat exchanger 14 or 114. For example, where the propellant is carbon dioxide and the water inlet temperature is 70° F. (21° C.), the maximum propellant pressure would be about 590 psig (i.e., about 41 atmospheres). A lower water inlet temperature will result in a lower carbon dioxide operating pressure. The pressure of propellant vapor as it enters engine 12 is slightly below the maximum due to pressure loss as the propellant flows from heat exchanger 14 or 114 to engine 12.

Lower operating pressures are attained when less volatile propellants such as dichlorodifluoromethane are used.

The water pressure increase in pump 10 is determined by the propellant pressure in engine 12 and the relative areas of pistons 22 and 32. With carbon dioxide at 590 psig as the propellant and a piston area ratio (area of piston 22 divided by area of piston 32) of about 4.63:1, water can be pumped in pump 10 from an inlet pressure of 0 psig to and an outlet pressure of 92 psig. These pressures are merely exemplary; if the inlet pressure is either higher or lower, the outlet pressure will be correspondingly higher or lower.

By way of specific illustration, the present pump assembly is especially well suited for use as a residential fire fighting apparatus. Current National Fire Protection Association (NFPA) requirements specify that a residential fire fighting system must be able to deliver at least 13 gallons of water per minute to each of two sprinkler heads for at least 10 minutes (i.e., a total of 260 gallons of water). The present apparatus, when supplied with two sprinkler heads (not shown) at the end of discharge conduit 90 and a suitable quantity of propellant in tubes 42 (FIG. 1) or container 113 (FIG. 2) is capable of meeting this requirement.

Referring to FIG. 2, a preferred heat exchanger surface area and set of operating conditions which will meet this requirement, using liquid carbon dioxide ($CO_2$) as the propellant, is shown in Table I below.

TABLE I

| | |
|---|---|
| Quantity of stored liquid carbon dioxide | 47.8 lb |
| Heat transfer area | approx. 10.2 $ft^2$ |
| Water inlet temperature | 70° F. |
| Water outlet temperature | 50° F. |
| Liquid carbon dioxide inlet temperature | 35° F. |
| Carbon dioxide (gas) outlet temperature | 45° F. |
| Carbon dioxide (gas) outlet pressure | 590 psig |

The above heat transfer area is a calculated value based on the water and carbon dioxide temperatures specified in Table I, and should be regarded as approximate. The liquid carbon dioxide inlet temerature in Table I is an assumed (and approximate) value based on the assumption that carbon dioxide is stored in tank 113 at ambient temperature (which may vary) and that some pressure and temperature loss will occur as carbon dioxide passes through valve 154.

The present apparatus can be used for other emergency applications, such as a standby water pumping system for use during a power outage, or an emergency cooling system for a chemical reactor.

The apparatus of this invention has several advantages over the apparatus of copending application Ser. No. 354,223 cited supra. First, the water source can be at atmospheric pressure; neither a pressurized water tank nor a source of water under pressure is necessary. Secondly, the present apparatus is better suited to using carbon dioxide as a propellant than is the apparatus of the earlier application, because the engine herein is more readily designed for the high operating pressures of carbon dioxide than is the water tank of the earlier apparatus.

The present apparatus also has a significant advantage over prior art systems using a liquifiable gas propellant for motive power. No prior art system to applicant's knowledge utilizes the heat content of the stream being pumped to supply the heat of vaporization of the propellant. If the propellant is vaporized without supplying heat, there is a drop in temperature with an attendant loss of pressure. In the present system, the operating pressure of propellant vapor is significantly higher, and the amount of work obtained from a given quantity of propellant significantly greater, than would be the case if the propellant is not heated as it is vaporized.

What is claimed is:

1. An emergency vapor powered pump assembly comprising:

(a) a pump for pumping a liquid from a lower pressure to provide a liquid at a higher pressure;

(b) an engine powered by high pressure vapor driving said pump;

(c) a volatile propellant held in a container means, said container means being in contact with said liquid at higher pressure to provide heat to said propellant thereby generating propellant vapor; and (d) a conduit for conveying said propellant vapor from said container means to said engine to power said engine.

2. An assembly according to claim 1 in which said pump comprises a first cylinder having a first piston therein, said engine comprises a second cylinder having a second piston therein, and said first and second pistons are mounted on a common piston rod.

3. An assembly according to claim 1 including a valve in said conduit means for initiating or stopping operation of the assembly.

4. An assembly according to claim 1 in which said container means contains a quantity of propellant stored in liquid form under pressure.

* * * * *